United States Patent [19]

White

[11] Patent Number: 4,701,953

[45] Date of Patent: Oct. 20, 1987

[54] SIGNAL COMPRESSION SYSTEM

[75] Inventor: Mark W. White, Oakland, Calif.

[73] Assignee: The Regents of the University of California, Berkeley, Calif.

[21] Appl. No.: 633,943

[22] Filed: Jul. 24, 1984

[51] Int. Cl.[4] ..... G10L 5/00

[52] U.S. Cl. ..... 381/46; 381/72; 381/106; 333/14

[58] Field of Search ..... 381/29–31, 381/68, 104–109, 72; 333/14

[56] References Cited

U.S. PATENT DOCUMENTS 4,363,007 12/1982 Haramoto et al. ..... 333/14

4,454,609 6/1984 Kates ..... 381/106

4,538,234 8/1985 Honda et al. ..... 381/31 X 4,562,591 12/1985 Stikvoort ..... 381/106

*Primary Examiner*—E. S. Matt Kemeny

*Attorney, Agent, or Firm*—Flehr, Hohbach, Test, Albritton & Herbert

[57] ABSTRACT

A signal compression system includes a plurality of channels. A plurality of these channels include a bandpass filter (for filtering out all but a portion of an input signal), an intensity detector (for deriving a spectrally weighted estimate of the intensity of a broader spectral portion of the input signal than the bandpass filtered spectral portion), and a divider (for compressing the bandpass filtered spectral portion using a variable gain having a preselected functional relationship to the spectrally weighted intensity estimate). The signal compression system preserves cross-channel information.

13 Claims, 9 Drawing Figures

FIRST EMBODIMENT

*SINGLE CHANNEL COMPRESSOR FIGURE 1A*

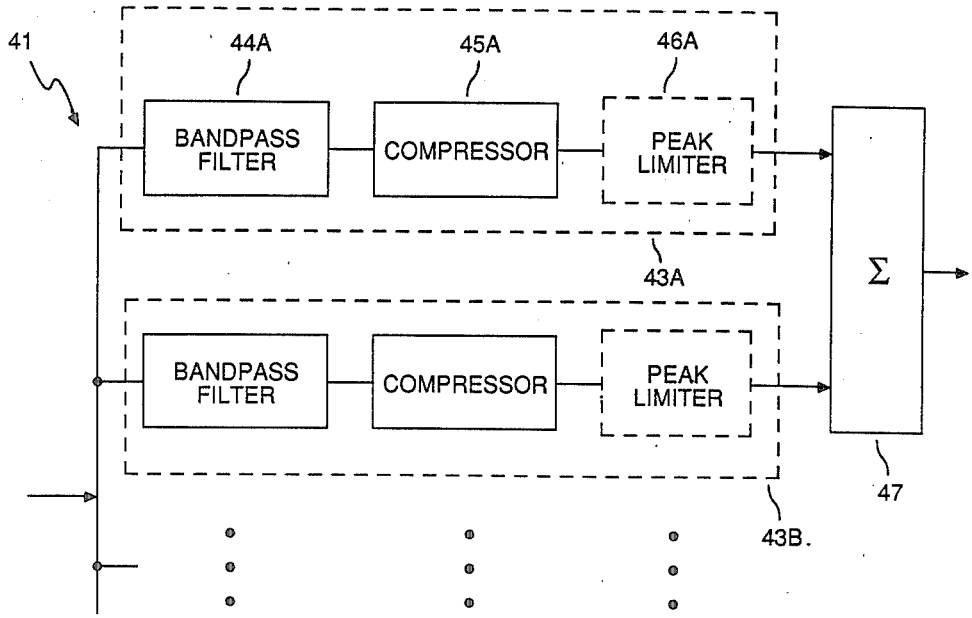
*MULTI-CHANNEL COMPRESSOR FIGURE 2*
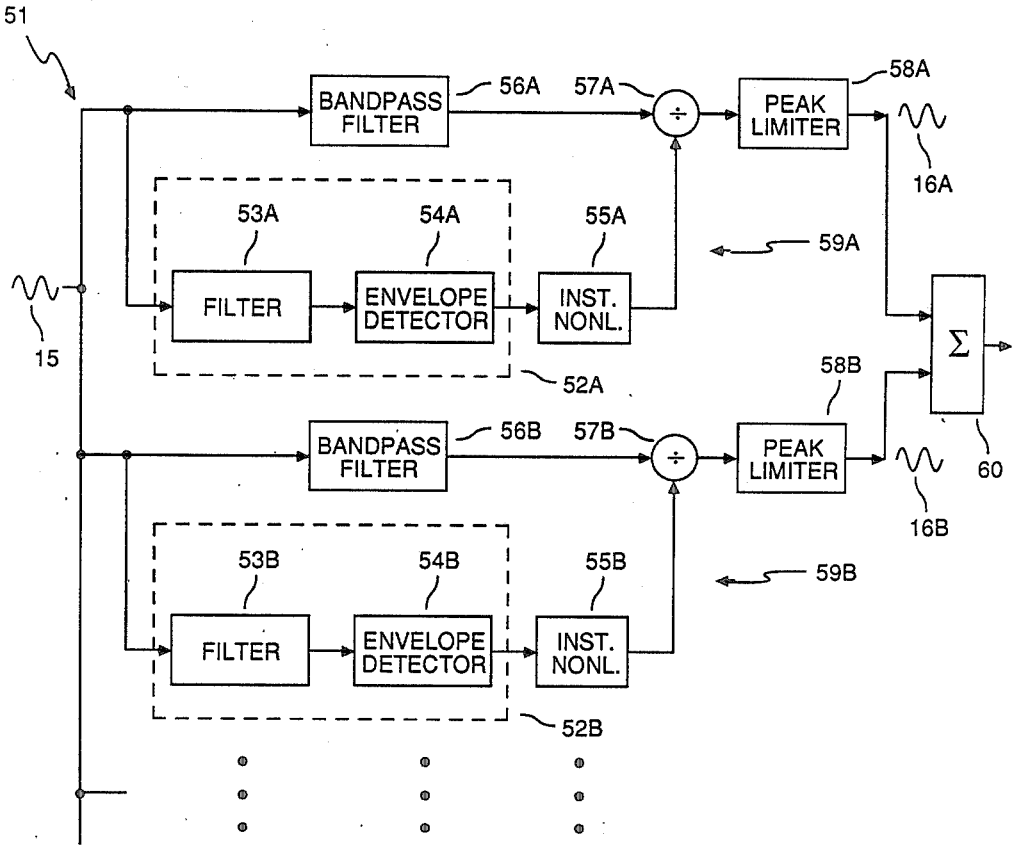
*FIRST EMBODIMENT FIGURE 3*

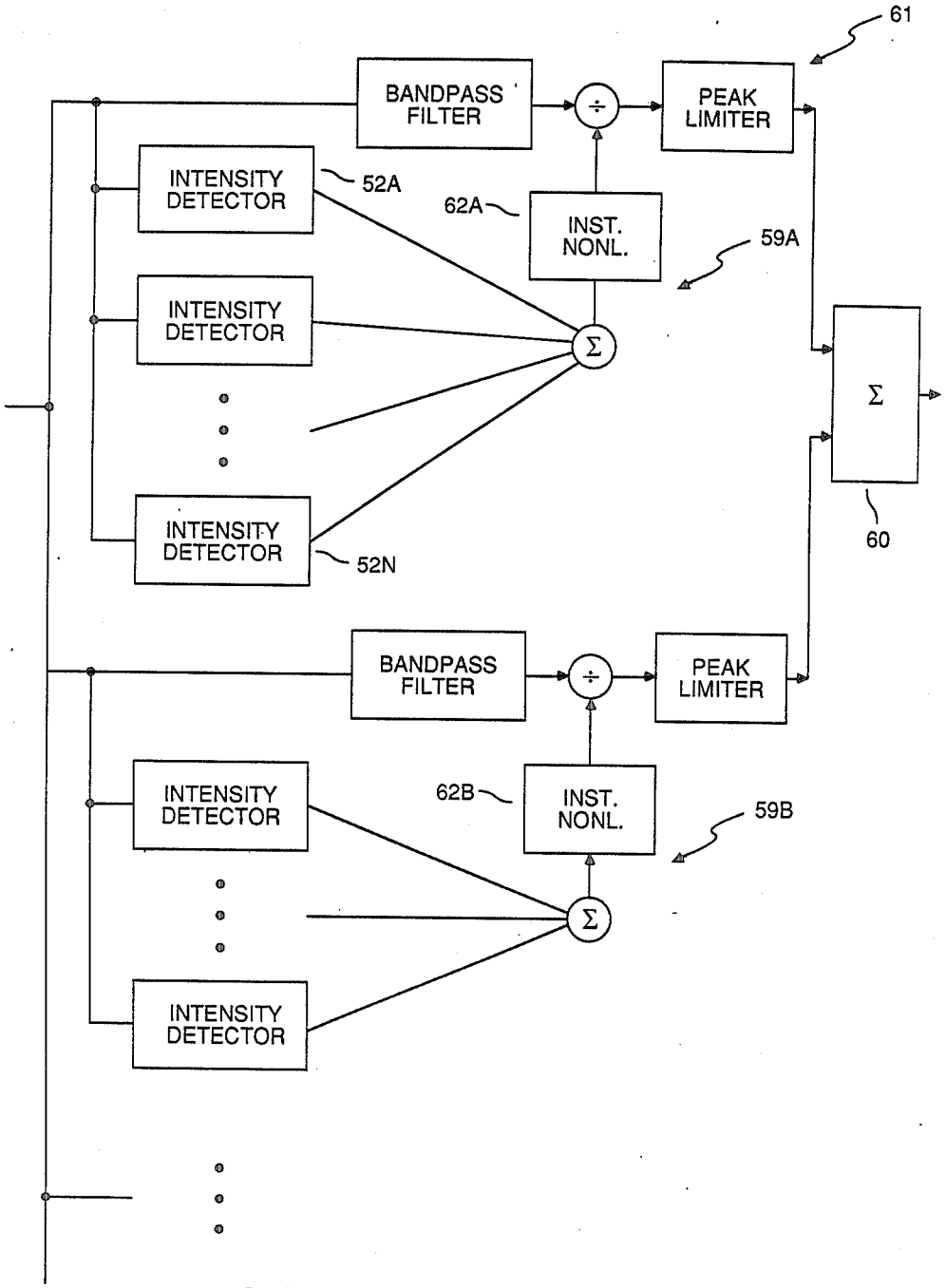
*SECOND EMBODIMENT FIGURE 4*

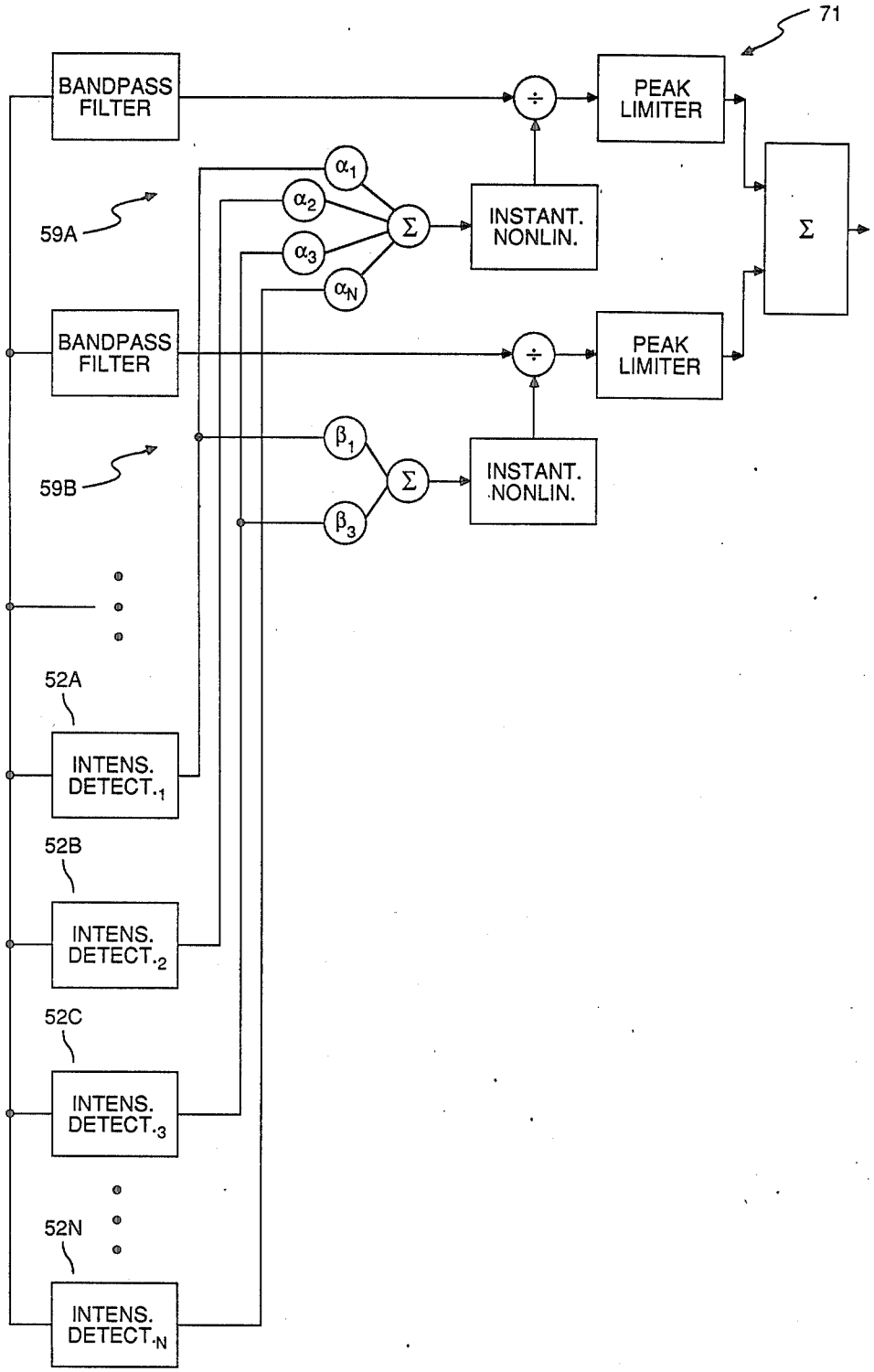
*THIRD EMBODIMENT FIGURE 5*

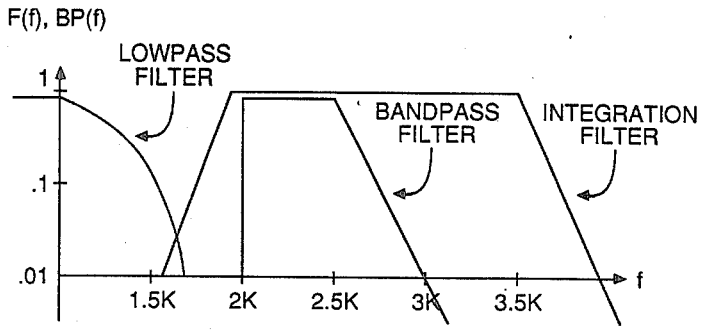
*FILTER CHARACTERISTICS FIGURE 6*
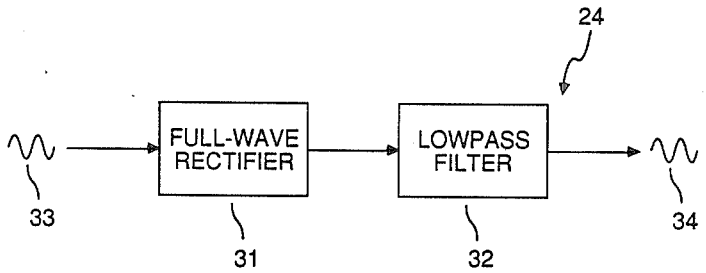
*ENVELOPE DETECTOR FIGURE 7*
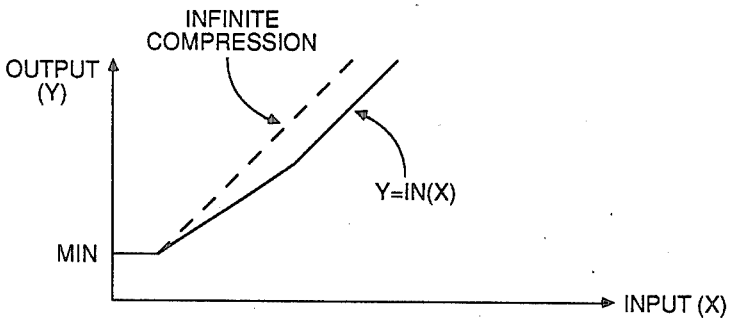
*INSTANTANEOUS NON-LINEARITY FIGURE 8*

SIGNAL COMPRESSION SYSTEM

The present invention relates generally to a signal compression system and method, and particularly to an audio signal compression system and method suitable for use in hearing aid and cochlear implant devices.

In many signal processing systems it is necessary to compress the dynamic range of the signal being processed. The goal in such systems is generally to maximize the retention of relevant information in the signal in spite of the reduction of the information bandwidth of the signal. One area of technology where signal compression is often required is in audio signal and speech transmission systems. The method of the present invention, however, also applies to other types of systems requiring low-spectral distortion, fast-acting, amplitude compression of wide band signals.

Examples of the types of prior art systems using signal compression range from radio and television broadcast stations, to military and commercial voice communication systems, to hearing aids which attempt to compress 120 db of audio signal amplitude variation into 30 db or less for reception by a person whose ears have a corresponding small dynamic receptive range.

The most relevant prior art references on the subject of audio signal compression for hearing aid devices known to the inventor include: P. Yanick, Jr. and S.F. Freifeld, The Application of Signal Processing Concepts to Hearing Aids, Grune & Stratton, New York (1978); L. D. Braida, Hearing Aids—Review of Past Research on Linear Amplification, Amplitude Compression, and Frequency Lowering, American Speech-Language-Hearing Association (ASHA) Monographs Number 19 (April 1979); G. A. Studebaker and F. H. Bess, The Vanderbuilt Hearing-Aid Report, Monographs in Contemporary Audiology, Upper Darby, Pa. (1982); S. De Gennaro, Third-Octave Analysis of Multichannel Amplitude Compressed Speech, Proc. ICASSP 1981, p. 125, IEEE; R. P. Lippman, Study of Multichannel Amplitude compression and linear amplification for persons with sensorineural hearing loss, J. Acoust. Soc. Am., vol. 69, No. 2, pp. 524–534 (Feb. 1981); L.K. Henrickson, The Effects of Modifying Time-Varying Amplitude Pattern on the Perception of Speech by Hearing-Impaired and Normal Listeners, Ph.D Dissertation, Stanford University (1982); and K. K. Clarke and D. T. Hess, Communication Circuits: Analysis and Design, Addison-Wesley Publishing Co., Reading Ma. (1971).

Prior art audio signal compression systems have suffered several characteristic deficiencies. As will be discussed below, single channel systems cannot compress wideband signals without suffering from either spectral distortion and/or inability to respond quickly to fast transients. When the input signal contains noise in addition to the desired speech signal, single channel systems unnecessarily suppress the speech information. Single channel compressors cannot compress the input signal differentially as a function of frequency; however this invention and prior art multi-channel compressors are capable of different levels of compression as a function of frequency. Prior art multi-channel systems, however, unnecessarily suppress spectral intensity information called cross-channel information. The prior art multichannel systems have also generally suffered from the "spectral integrity versus fast reaction to transients" tradeoff problem characteristic of single channel systems. In fact, in prior art multi-channel systems using more channels has generally resulted in less intelligible output signals.

The present invention was conceived from the realization that (1) the most important part of an audio signal to a hearing impaired person is the cross-channel information (i.e., spectral information) and not the overall intensity of the signal; and (2) that a particular method of signal processing could simultaneously (a) compress average intensity variations and (b) emphasize or "decompress" cross-channel information while circumventing the seemingly unpreventable tradeoff in prior art compression systems between spectral distortion and the ability to react quickly to transients. The invention itself, however, is a particular system and method of signal processing, independent of the validity of the theory upon which it is based.

Retaining the spectral characteristics of the input signal (also called retaining spectral integrity) is important because spectral information is a very important part of any subjective quality signal (and is essential to the communication of speech). Fast response to transients is important in order to avoid transmitting signals greater than a certain maximum amplitude (e.g., which is uncomfortable to one listening to the compressed audio signal), or to keep the output signal within a predefined dynamic range.

It is therefore a primary object of the present invention to provide an improved signal compression system.

Another object of the invention is to provide a signal compression system that emphasizes or "decompresses" cross-channel information and compresses (i.e., de-emphasizes) absolute intensity information. Yet another object of the invention is to circumvent the tradition tradeoff in signal compression systems between retaining spectral integrity and reacting quickly to transients.

Still another object of the invention is to substantially reduce the deleterious effects of noise in a signal compression system.

In summary, a signal compression system in accordance with the invention includes a plurality of channels. A plurality of these channels include a bandpass filter (for filtering out all but a portion of an input signal), an intensity detector (for deriving a spectrally weighted estimate of the intensity of a broader spectral portion of the input signal than the bandpass filtered spectral portion), and a divider (for compressing the bandpass filtered spectral portion using a variable gain related in a preselected manner to the spectrally weighted intensity estimate).

Additional objects and features of the invention will be more readily apparent from the following detailed description and appended claims when taken in conjunction with the drawings, in which:

FIGS. 1A, and 1B depict block diagrams of prior art single channel signal compression systems.

FIG. 2 depicts a block diagram of a multi-channel signal compression system.

FIG. 3 depicts a block diagram of a first embodiment of a multi-channel system in accordance with the invention.

FIG. 4 depicts a block diagram of a second embodiment of a multi-channel system in accordance with the invention.

FIG. 5 depicts a block diagram of a third embodiment of a multi-channel system in accordance with the invention.

FIG. 6 depicts a graph of typical filter characteristics of one channel of a multi-channel system in accordance with the invention.

FIG. 7 depicts a block diagram of an envelope estimator which is also referred to an an envelope detector or an intensity detector.

FIG. 8 depicts a graph of a typical instantaneous non-linearity for use in a system in accordance with the invention.

Figure 1B:
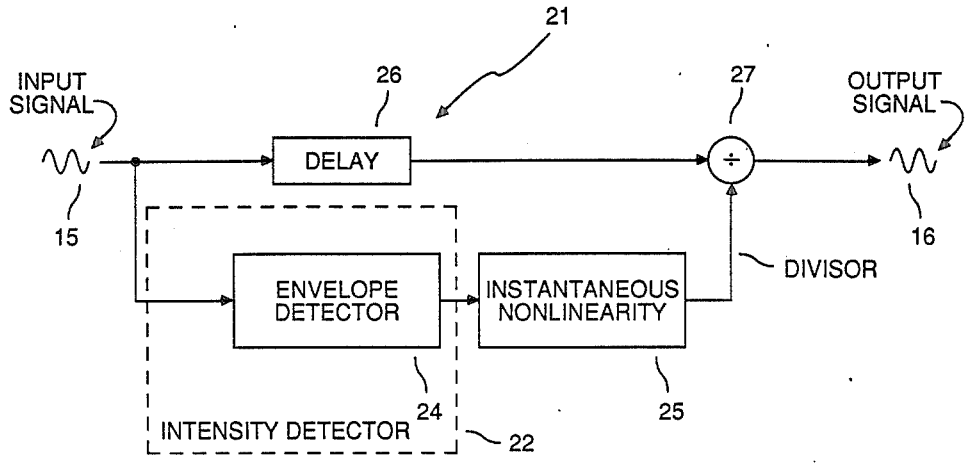

Referring to FIGS. 1A and 1B, there are shown two typical configurations of prior art single channel signal compression circuits or systems. The primary goal of most any signal compression system, and certainly any audio signal compression system, is to retain, as well as possible, the most relevant information of the signal being compressed while maintaining the signal level within the operating range of the receiver. As will now be explained, single channel signal compression systems are inherently unable to achieve high quality compression of wide-band signals. The one inescapable characteristic of every channel of a signal compressor is that its gain must change over time in order to maximize the amount of information retained in the signal while compressing the input signal into a predefined dynamic range. One way to understand this is to consider the characteristics of the human ear. At any particular frequency or range of frequencies the human ear can be characterized by its limen (the minimum noticeable difference in amplitude, usually measured in decibels), the minimum noticeable signal, the maximum amplitude signal which is not painful to the listener (the pain threshold), and the number of limens between said minimum and maximum amplitudes. All of the useful information of the input signal at a particular frequency must be compressed into the listener's available limens at that frequency (also called the output signal's available or predefined dynamic range). If an amplifier's gain is not variable then it must be fixed at a value such that the loudest sounds expected to be encountered are output at a tolerable level. Since most sounds of interest will be much less intense than the loudest sounds one will generally encounter, such a fixed-gain system will deprive the listener of much of the information in the input signal because many sounds will be lower in amplitude than the minimum noticeable signal. In order to reduce this loss of information, a signal compression system should increase the system's gain when the input signal has a relatively low average amplitude and should decrease the system's gain when the input signal is high in amplitude. There is substantial experimental evidence that the human ear, when properly functioning, performs a similar function.

Note that for high amplitude input signals, the output signal can be peak limited or otherwise prevented from exceeding a predefined maximum allowable amplitude using well known techniques, so long as the information content of these loud signals (i.e., the information conveyed by changes in the signal amplitude of these high amplitude signals) can be sacrificed.

Given that the gain of a compression system must vary over time in order to maximize the transmission of information, the goal of the system designer is to determine the ideal amount and rate at which to vary the compressor's gain (also called the compression ratio). Alternately stated, the goal of the system designer is to determine the ideal integration window over which the system should derive an estimate of the intensity of the input signal and the corresponding gain of the compressor.

For a single channel system which must compress a wide-band input signal, the selection of an ideal integration window "t" is impossible. In this context, a "wide-band" signal is any signal whose bandwidth is significantly greater than the lowest frequency component within that signal. Speech signals, which cover a spectrum ranging approximately from 100 Hz to 8000 Hz, fall withing this category. If the integration window "t" is relatively short, the lower-frequency spectral components of the signal will be spectrally distorted because the compressor's gain will change in less than one cycle time of those components. If the integration window "t" is relatively long, the listener will be subject to signal transients above his pain threshold because the system will not be able to react quickly enough to fast changes in the amplitude of the input signal. Even if a peak limiter or similar means is used to prevent such high amplitude outputs, at least a portion of the information content of the high amplitude input signal will be lost. Also, if the integration window "t" is relatively long, the listener will be subjected to signal transients that fall below the level of audibility because the system will not be able to increase its gain quickly enough to compensate for the signal's decrease in amplitude.

Referring to FIG. 1A, there is shown a single channel signal compression system 21 having an intensity detector 22 and an instantaneous non-linearity 25 for determining the compressor's gain. The intensity detector 22 typically comprises an envelope detector 24. The input signal 15 is delayed by delay element 26 for a time corresponding to the signal delay time through detector 22. The output signal is generated by divider 27, which compresses (or scales down) the output of the delay element 26 using a variable gain that is computed or derived by the instantaneous non-linearity 25 from the output of the intensity detector 22.

The term "divider" is used in the description of the preferred embodiments to refer to a variable gain amplifier or other device capable of scaling down (or dividing) an input signal by a specified quantity or scale factor (sometimes herein called the divisor). The gain of the divider is generally controlled by a signal (sometimes herein called the divisor) whose amplitude is proportional to an estimate of the intensity of at least a selected spectral portion of an input signal. The gain of the divider is inversely proportional to the intensity estimate: the larger the intensity estimate, the smaller the gain of the divider (i.e., the more the input signal will be compressed). Since the invention is primarily concerned with signal compression systems, the variable gain will often, but possibly not always, be less than one and the output signal will be smaller than the input signal.

As shown in FIG. 7, a typical envelope detector 24 includes a full- or half-wave rectifier 31 followed by a low pass filter 32. The output 34 of the envelope detector 24 is an estimate of the intensity of the signal 33 entering the envelope detector 24. It has an integration window corresponding to the cutoff frequency of the low pass filter 32 (i.e., $t=1/f$, where t is the integration window's approximate effective duration and f is the cutoff frequency of filter 32). The purpose of the rectifier 31 is to spectrally separate envelope from non-envelope components of a signal. See Clark Hess, referenced above. The use of a full-wave rather than a half-wave rectifier is preferred because the non-envelope components of the signal being processed are generated at higher frequencies, which are then easier to filter out using a low pass filter 32.

Referring now to FIG. 8, the function of the instantaneous non-linearity 25 is as follows. First the compressor's gain must not be allowed to go above a certain maximum value because otherwise amplifier noise and background noise associated with "silence" will be amplified to uncomfortable levels. Second, the instantaneous non-linearity 25 (which can be mathematically denoted $Y=IN(X)$, where X is the input signal, Y is the output signal, and IN is a predefined non-linear function) is used to set the amount of compression over the compressor's operating range. Restated, the instantaneous non-linearity 25 translates (in a non-linear fashion) the intensity estimate from the envelope detector 24 into a signal which controls the variable gain of the compressor.

Referring to FIG. 1B, there is shown a second single channel signal compression system 28 having an intensity detector 22 and an instantaneous non-linearity 25 for controlling the compressor's gain. As explained above, the intensity detector 22 typically comprises an envelope detector 24. A fixed gain amplifier 29 is inserted between the variable gain compressor 27 and the system's output. The feedback compression system 28 shown in FIG. 1B has essentially the same characteristics as the feedforward system 21 shown in FIG. 1A. However, in the feedback configuration it is not possible to exactly synchronize the gain-control signal with the input signal. The lag between the envelope estimate and the input signal will generate additional distortion.

Many standard single-channel compression systems use separate "attack" and "release" integration windows. Generally, a relatively short integrating time constant is used during the attack interval (i.e., during the segments in which the envelope is increasing in amplitude) compared with the time constant used during the release interval. Such compressors generate both spectral and temporal distortions. Spectral distortion is primarily generated during the fast attack phase and is particularly apparent with complex stimuli such as speech. The long release phase is plagued with "drop-outs" or "under-shoots" when the input signal abruptly decreases in level. The compressor's output level can drop well below threshold before the compressor's gain can sluggishly increase.

Single channel compressors perform especially poorly in certain types of noisy environments. Without compression, those types of noise which have most of their energy within relatively narrow spectral regions will primarily mask the speech signal in and around those spectral regions. The other spectral regions will be relatively free of interference. With a single channel compressor, when noise is added to a speech signal, all frequency regions are attenuated equally, without regard to the spectrum of the interfering noise. For example, a single high-amplitude "interfering tone" could cause the entire speech spectrum to be attenuated below audibility. Even spectral components of the speech that are very "distant" from the tone would be severly attenuated. Since these more distant spectral components would normally be relatively unmasked by the interfering tone, it makes little sense to attenuate the potentially useful information in these spectral components.

In all single channel compression systems (e.g., systems 21 and 28) there is an inherent selection of an integration window and thus there is an inherent tradeoff between accurate spectral reproduction and fast response to transients in the signal's level.

Referring now FIG. 2, there is shown a typical multichannel signal compression system 41. In each channel 43 the bandpass filter 44 passes a portion of the input signal's frequency spectrum which is mutually exclusive (or minimally overlapping) with the portion passed by the bandpass filters in the other channels. In applications where a single wide-band output signal is needed (e.g., for a hearing aid), the outputs of the channels 43 may be "added together" by summer 47. Clearly, in applications where separate output signals for each channel are needed (e.g., for a multielectrode cochlear implant device), the outputs of all the channels 43 are not "added together" using a summer 47.

The idea behind prior art systems using the general system configuration shown in FIG. 2 is that separate processing of each channel should allow the system to separately compress its corresponding spectral component into the available dynamic range of the listener. (Note that in most cases the available dynamic range of the listener is significantly different for each channel or band.) However, there is a curious phenomenon that prior art multi-channel signal compression systems have generally performed even worse than single channel compression systems. In fact, the more channels used the worse the systems performed. The problem was evidenced by the observation of the listeners "that everything sounds the same". The causes of the problem include: the use of an inappropriate integration window for each channel; and the suppression of cross-channel information, because the prior art multi-channel systems compressed cross-channel level differences.

In all prior art versions of system 41 known to the inventor, all the channels 43 use the same integration window. This causes the same problem as arises in single channel systems: the integration window will be too short for some channels and too long for others. In light of the above explanation, it is clear that using a compressor 45 in each channel 43 with a distinct integration window corresponding to the frequency range of the channel will produce an improved signal compression system.

Figure 1B:
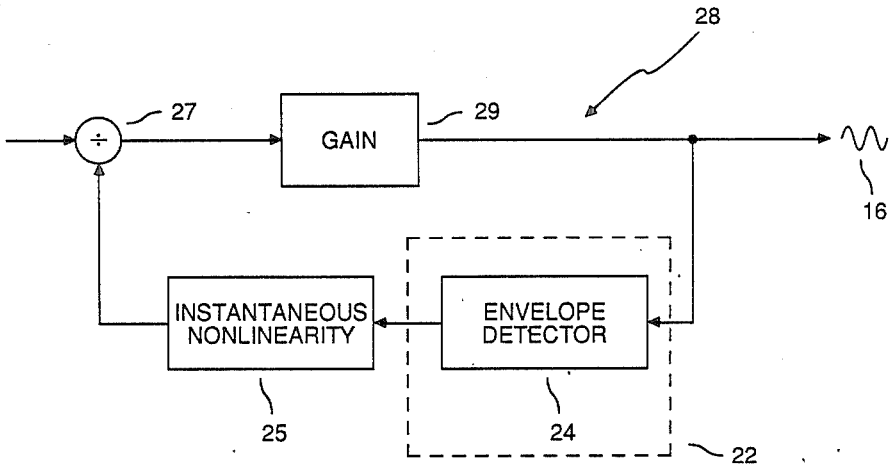

Still referring to FIG. 2, the selection of an appropriate integration window for each channel 43 in a multichannel system 41 (wherein each compressor 45 in the system 41 is similar in design to the compressor 21 shown in FIG. 1, and each envelope detector 24 in each compressor 45 is as shown in FIG. 7) in accordance with the invention is as follows. While it is desirable for the compressor 45 to be able to respond quickly to changes in level, to minimize spectral distortion the lowpass filter 32 (see FIG. 6) should only pass spectral components which represent the envelope of the signal passed by bandpass filter 44 (see FIG. 2). Therefore the upper limit for the lowpass filter 32's bandpass should be set no higher than the low frequency edge of the non-envelope components of the signal passed by bandpass filter 44. The full-wave rectifier 31 causes non-envelope components of the signal passed by bandpass filter 44 to be shifted into higher frequencies which are then filtered out by lowpass filter 32. For more discussion of the use of rectifiers in signal processing, see Clarke and Hess (1971), referenced above.

In certain applications it may be advantageous to emphasize the high frequency components of a channel's signal (i.e., to emphasize the rapid transitions in a channel's signal level) as opposed to the slower transitions. For instance, this may be advantageous where a high percentage of the information transmitted by a channel is contained in its high frequency components. Emphasis of rapid transitions will occur if the integration window is lengthened in duration (i.e., the cutoff frequency of the lowpass filter 32 is lowered somewhat). In such applications it will usually be necessary to use some form of peak-limiting to prevent transitions from becoming uncomfortably loud.

While the performance of a multi-channel signal compression system 41 can be improved by giving each channel an individually tailored integration window, the performance of multi-channel signal compression systems can be improved even more dramatically by specifically building the system to decompress or emphasize "cross-channel" information. Cross-channel information comprises the information represented by the difference in the intensities of the spectral components of a signal passed through various distinct channels. Information is transmitted when these patterns change over time. With a sufficient number of channels, cross-channel information is essentially that information contained in the shape of the spectrum of the signal). Furthermore, cross-channel information (as opposed to the overall signal level) comprises the most relevant information in an audio signal for discerning speech and most other sounds.

The prior art systems provide no means for decompressing or emphasizing cross-channel information. In fact, since the instantaneous gain of each channel is independently determined from only the energy of the spectral portion of signal passed by the channel, the differences in intensities of the various spectral portions of the input signal are suppressed. In other words, prior art multi-channel systems compress changes in cross-channel level differences as much as they compress changes in overall signal level. It is for this very reason that single channel systems often work better than prior art multi-channel systems; the single channel systems do not compress cross-channel information. However, the single channel systems have other severe faults, as previously discussed.

The systems shown in FIGS. 3, 4 and 5 show three embodiments of a multi-channel signal compression system which is capable of emphasizing cross-channel information and solves the worst problems in prior art systems. As a preliminary note, while the systems are described in terms of components that can be made using analog circuitry, these systems are equally well suited for digital embodiments. In such digital systems, as is well known in the art, the input signal is sampled and digitized periodically (e.g., 8000 times per second), digitally filtered using well known techniques, and then reconstructed using standard digital-to-analog circuitry. Initial testing of the invention was performed by the inventor by simulating a system similar to the one shown in FIG. 3 on a digital computer using such techniques. Referring to FIG. 3, there is shown a multi-channel signal compression system 51. Each channel 59 includes a bandpass filter 56 that passes a portion of the input signal's frequency spectrum which is mutually exclusive (or minimally overlapping) with the portion passed by the bandpass filters in the other channels. A divider 57 in each channel divides the output of the bandpass filter 56 by the channel's "divisor" produced by intensity detection means 52 (which generally includes a filter 53 and an envelope detector 54) and instantaneous non-linearity 55. The outputs of the channels 59 may be "added together" by summer 60 to form a single wide-band output signal. As noted above, the outputs of the the channels 59 are not added together by a summer 60 in embodiments where separate output signals for each channel 59 are needed.

Also as discussed above, the envelope detector 54, one embodiment of which is shown in FIG. 7, derives an estimate of the intensity of the signal passed by filter 53 using an integration window which is no faster than 1/f where f is the lowest frequency passed by bandpass filter 56. The size of the band passed by filter 53 and the duration of the integration window are selected so that spectral distortion is minimized while the reaction time of the system is kept fast enough to prevent transients above the pain threshold from being transmitted to the listener. Alternatively, as discussed above, the integration window can be made somewhat longer and a peak limiter type element can be used to filter out transients above a certain predefined amplitude. The most critical design parameter in the design of a signal compressor 51 is the selection of the characteristics of the filter 53 in each channel 59. Generally filter 53 should pass a broader band than bandpass filter 56 so that the estimate of the input signal's intensity and therefore the channels "divisor" will reflect the intensity of the signal in spectral ranges outside the one of the channel thereby improving the transmission of cross-channel information. The portion of the signal passed by filter 53 is called herein the integration band, and filter 53 is sometimes called the integration filter or the integration band filter. The integration band in the general case comprises a weighted sum of all the spectral components of the input signal. Those portions of the input signal which are totally filtered out are given a weight of zero. Other portions can be given any preselected weight by means of a properly designed filter 53. This weighting function can either be a time invariant function of frequency (the standard case) or can be dynamic (i.e., responsive to certain signal and time dependent criteria using techniques well known to those skilled in the art of designing dynamic filters, but beyond the scope of the present description). The preferred embodiments discussed herein use time invariant integration filters 53, but the general method of the invention applies equally well to systems using dynamic weighting integration filters in one or more channels.

The selection of a proper integration band (i.e., a proper integration filter 53) for each channel is basically an empirical task. Nevertheless several general points can be made. First, the integration filter 53 should generally be weighted so as to include only a portion of the input signal that is lower in frequency than the lowest frequency passed by the bandpass filter 56 of the channel. FIG. 6 illustrates the relationships between the three filters in a typical channel. While it is desirable for the intensity detector 52 to be able to respond quickly to changes in level, to minimize spectral distortion the lowpass filter 32 (see FIG. 7) of the envelope detector should only pass spectral components which represent the envelope of the signal passed by the integration filter 53. Therefore the upper limit for the lowpass filter 32's bandpass should be set no higher than the low frequency edge of the non-envelope components of the signal passed by integration filter 53 and the full-wave rectifier 31.

Second, the integration band should also not include or not heavily weight high frequency components of the input signal that are so far removed from the band of the channel that the cross-channel information between the two is likely to be irrelevant to the listener. As will now be shown, multi-channel compressors can be designed to be more "robust" to noise than single channel compressors. As already explained above, single channel compression systems are especially vulnerable to those forms of noise which have most of their energy within relatively narrow spectral regions.

In multi-channel compressors in accordance with the invention, a given channel's gain will not be affected by "distant" noise components if integration filter 53 rejects "distant" spectral components. For instance, by setting the center frequency of the integrating band (i.e., of filter 53) equal to the center frequency of bandpass filter 56 and appropriately restricting the bandwidth of filter 53, the compressor of FIG. 3 can be made "robust" to a wide range of noise spectra. As another example, if the range of cross-channel information which is perceptually important covers a spectral range of one octave, then spectral components more than one octave away from the spectral portion passed by a particular channel can be considered to be spectrally "distant" from that channel.

As the bandwidth of integration filter 53 is narrowed from an initial wide-band condition, the differences in magnitudes of widely-separated spectral components of the input signal will be increasingly compressed more than the magnitude differences of more closely spaced spectral components. If the integration band is further reduced, even local differences in spectral magnitudes will be severly compressed and the compressor will loose important cross-channel information. In speech and other applications, the relative perceptual importance of "coarse-grain" or "wide-spread" features versus the importance of more "local" spectral features is used to determine the frequency response of each channel's integration band filter 53. (E.g., if the relative amplitudes of widely separated spectral components are important, then the integration band filter 53 should pass a similarly wide spectrum.) Also, the spectral characteristics of expected noise in the input signal is significant in selecting the appropriate frequency response for the integration filters 53.

As shown in FIG. 3, in one preferred embodiment of the invention each of a plurality of channels has a separate intensity detector 52 with its own individually tailored integration filter 53, envelope detector 54 and instantaneous non-linearity 55. The same general system and method can be performed in several similar but distinct configurations. Optionally, each channel can have a peak limiter 58 and the output signals 16 from all channels can be added together by summer 60.

In FIG. 4 there are a plurality of channels 59 each having a plurality of intensity detectors 52*a* - 52*n*. Generally, each intensity detector 52 will cover a distinct integration band, although the integration of the various detectors may overlap. For each channel 59, the compressor's gain is an instantaneous nonlinear function 62 of a weighted sum of the output of the intensity detectors. In the case where each channel uses the output from only one intensity detector, the circuit shown in FIG. 4 is identical in function to the one shown in FIG. 3. The advantage of the embodiment shown in FIG. 4 is that it makes possible the use of more complex weighting functions than can be used in systems of the type shown in FIG. 3.

In FIG. 5 there are a plurality of intensity detectors 52*a*–52*n* but they are not specifically allocated to any one channel 59. Generally, each intensity detector 52 will cover a distinct integration band, although the integration of the various detectors may overlap. As in the system shown in FIG. 4, for each channel the gain is determined by an instantaneous nonlinear function 62 of a weighted sum of the output of one or more intensity detectors. In the case where each channel uses the output from only one intensity detector, the circuit shown in FIG. 5 is identical in function to the one shown in FIG. 3. The advantage of the embodiment shown in FIG. 5 over the system in FIG. 3 is that it makes possible the use of more complex weighting functions than can be used in systems of the type shown in FIG. 3. The advantage of the system in FIG. 5 over the system in FIG. 4 is that it generally requires less resources because of the multiple use of at least some of the intensity detectors.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A signal compression system for compressing a broadband signal, comprising: a plurality of channel filters each including:

bandpass filter means for filtering out all but a first spectral portion of said broadband signal;

integration filter means for filtering out all but a second spectral portion of said broadband signal, said second spectral portion being significantly broader than said first spectral portion of said broadband signal; and envelope detector means for deriving an estimate of the intensity of the signal passed by said integration filter means, said envelope detector means having an integration window corresponding to the low frequency end of the non-envelope components of the signal passed by said integration filter means; and means for compressing the signal passed by said bandpass filter means using a variable gain having a preselected functional relationship to said derived intensity estimate.

2. A signal compression system as set forth in claim 1, wherein said first spectral portion is substantially distinct for each said channel;

and wherein, for each said channel, the intensity estimate derived by said envelope detector means comprises a weighted average of the spectral components of the signal passed by said integration filter means.

3. A signal compression system as set forth in claim 1, wherein said means for compressing includes instantaneous nonlinearity means for translating, in a nonlinear manner, said intensity estimate derived by said envelope detector means into a signal which controls said variable gain.

4. A signal compression system as set forth in claim 3, wherein each of a plurality of said channels further includes peak limiter means for clipping signals, generated by said means for compressing, which exceed a preselected maximum amplitude.

5. A signal compression system as set forth in claim 1, wherein said integration filter means in each said channel is designed to filter out noise which is spectrally distant from said first spectral portion passed by said bandpass filter means for said channel.

6. A signal compression system as set forth in claim 1, wherein said second spectral portion of said broadband signal for each said channel is selected so that at least a perceptually noticeably greater portion of the cross-channel information in said broadband signal is preserved by said signal compression system than if said second spectral portion were the same as said first spectral portion of said broadband signal.

7. A method of compressing a broadband signal, the steps of the method comprising:

bandpass filtering at least certain selected spectral portions of said broadband signal and thereby generating a plurality of bandpass filtered spectral portions of said broadband signal;

for each of at least a plurality of said bandpass filtered spectral portions of said broadband signal:

generating an integration signal using a second spectral portion of said broadband signal which is significantly broader than said bandpass filtered spectral portion of said broadband signal;

deriving an estimate of the intensity of said integration signal using an integration window corresponding to the low frequency end of the non-envelope components of said integration signal; and compressing said bandpass filtered spectral portion of said broadband signal using a variable gain corresponding to said derived estimate of the intensity of said integration signal.

8. The method of claim 7, wherein said step of generating an integration signal includes the steps of:

filtering said broadband signal to generate a preintegration signal using a spectral portion of said broadband signal which is significantly broader than said bandpass filtered spectral portion of said broadband signal; and nonlinearly transforming said preintegration signal.

9. The method of claim 8, wherein said deriving step includes low pass filtering said integration signal and thereby removing components higher in frequency than the low frequency end of the non-envelope components of said integration signal;

whereby the integration window used for each bandpass filtered spectral portion corresponds to the rate of change of the envelope components of the corresponding integration signal.

10. A method of compressing a broadband signal, the steps of the method comprising:

bandpass filtering at least certain selected spectral portions of said broadband signal and thereby generating a plurality of uncompressed channel signals, each including a different bandpass filtered spectral portion of said broadband signal;

for each of at least a plurality of said uncompressed channel signals:

generating an integration signal using a spectral portion of said broadband signal which is significantly spectrally broader than said uncompressed channel signal; and compressing said uncompressed channel signal using a variable compression factor corresponding to the intensity of the envelope components of said integration signal.

11. The method of claim 10, wherein said generating step includes:

filtering said broadband signal to generate a preintegration signal using a spectral portion of said broadband signal which is significantly broader than the spectral portion of said broadband signal included in said uncompressed channel signal; and nonlinearly transforming said preintegration signal.

12. The method of claim 11, wherein said deriving step includes low pass filtering said integration signal and thereby removing components higher in frequency than the low frequency end of the non-envelope components of said integration signal;

whereby the integration window used for varying the compression factor for each channel signal corresponds to the rate of change of the envelope components of the corresponding integration signal.

13. The method of claim 10, wherein said step of generating an integration signal includes filtering out spectral components which could contain noise spectrally distant from said uncompressed channel signal.

* * * * *